US009986796B2

(12) United States Patent
Catanese et al.

(10) Patent No.: US 9,986,796 B2
(45) **Date of Patent: *Jun. 5, 2018**

(54) CLASP FOR A WATCH BRACELET OR A GARMENT BELT

(71) Applicant: OMEGA S.A., Biel (CH)

(72) Inventors: Rocco Catanese, Bienne (CH); Cedric Kaltenrieder, Bienne (CH); Gregory Kissling, Macolin (CH)

(73) Assignee: Omega S.A., Bienne (CH)

( * ) Notice: Subject to any disclaimer, the term of this patent is extended or adjusted under 35 U.S.C. 154(b) by 221 days.

This patent is subject to a terminal disclaimer.

(21) Appl. No.: 14/825,873

(22) Filed: Aug. 13, 2015

(65) Prior Publication Data

US 2015/0342309 A1 Dec. 3, 2015

Related U.S. Application Data

(63) Continuation of application No. 13/943,183, filed on Jul. 16, 2013, now Pat. No. 9,210,971.

(30) Foreign Application Priority Data

Sep. 4, 2012 (EP) ..... 12182983

(51) Int. Cl.
*A44C 5/24* (2006.01)
*A44B 17/00* (2006.01)
*A44B 11/00* (2006.01)

(52) U.S. Cl.
CPC ..... *A44C 5/24* (2013.01); *A44B 11/006* (2013.01); *A44B 17/0064* (2013.01); *Y10T 24/2155* (2015.01)

(58) Field of Classification Search
CPC ..... A44C 5/24; A44C 5/243; A44C 5/246; Y10T 24/4782

(Continued)

(56) References Cited

U.S. PATENT DOCUMENTS 1,689,640 A * 10/1928 Newman ..... A44C 5/24 224/176
1,902,535 A * 3/1933 Anderson ..... A44C 5/24 24/71 J (Continued)

FOREIGN PATENT DOCUMENTS

CH 692 124 A5 2/2002
DE 10 2011 101 905 A1 11/2011

(Continued)

OTHER PUBLICATIONS

European Search Report dated Jan. 15, 2013, in European Application No. 12 18 2983 filed Sep. 4, 2012 (with English Translation).

(Continued)

*Primary Examiner* — Jack W Lavinder
(74) *Attorney, Agent, or Firm* — Oblon, McClelland, Maier & Neustadt, L.L.P.

(57) ABSTRACT

A clasp for a watch bracelet or for a garment belt includes at least two unfolding arms articulated to each other, a first unfolding arm includes a first end attached to a bracelet strand and a second end pivotally articulated to a first end of a second unfolding arm, a second end of the second unfolding arm is traversed by an arbour about which there is articulated a cover with first and second flaps and to which another bracelet strand is attached. The clasp includes a push button fastening system, including at least one push button that controls a bolt pivotally mounted on the cover, the bolt includes a first hook cooperating with a second hook fitted to the first unfolding arm and keeping the second hook locked when the push button is not manually activated, the first hook being kept engaged with the second hook by an elastic structure.

12 Claims, 8 Drawing Sheets

(58) Field of Classification Search
USPC ..... 368/282; 224/164
See application file for complete search history.

(56) References Cited

U.S. PATENT DOCUMENTS

| | | | | |
|---|---|---|---|---|
| 4,928,359 | A * | 5/1990 | Gagnebin | A44C 5/2042 24/587.11 |
| 6,457,216 | B1 | 10/2002 | Lo | |
| 9,210,971 | B2 * | 12/2015 | Catanese | A44C 5/24 |
| 2004/0168469 | A1 * | 9/2004 | Tetu | A44C 5/24 63/3.1 |

FOREIGN PATENT DOCUMENTS

| | | |
|---|---|---|
| EP | 1 279 349 A1 | 1/2003 |
| EP | 2 502 516 B1 | 9/2012 |

OTHER PUBLICATIONS

Notice of the Reason for Refusal dated Oct. 7, 2014 in Japanese Patent Application No. 2013-168025 submitting English translation only.

* cited by examiner

CLASP FOR A WATCH BRACELET OR A GARMENT BELT

CROSS-REFERENCE TO RELATED APPLICATIONS

This application is a continuation of U.S. patent application Ser. No. 13/943,183 filed on Jul. 16, 2013, which claims priority to European Patent Application No. 12182983.2 filed on Sep. 4, 2012, the entire disclosures of each of which are incorporated herein by reference.

FIELD OF THE INVENTION

The present invention concerns a clasp for a watch strap or bracelet or for a garment belt.

BACKGROUND OF THE INVENTION

European Patent Application No 11159074.1 in the name of the Applicant discloses a clasp for a watch bracelet comprising two unfolding arms articulated to each other. A first end of the first unfolding arm is attached to a first strand of the bracelet, whereas a second end of the first unfolding arm is pivotally articulated on a first end of a second unfolding arm. The second end of the second unfolding arm is traversed by an arbour about which there is pivotally articulated a cover, provided with first and second flaps to which a second bracelet strand is attached. Finally, the clasp includes a lever fastening system for locking and unlocking first and second arms. According to the invention described in the aforementioned European Patent Application, the lever is pivotally mounted on the cover via a first hinge. The lever controls a lock or bolt which is in turn pivotally mounted on the cover via a second hinge which is distinct from the first hinge. The bolt, which is controlled by the lever, is arranged to cooperate with a hook fitted to the first unfolding arm and to lock the lever when the lever is pushed into a fastening position. An elastic means is provided for holding the lever down and the bolt engaged with the hook when the lever is not being manually activated.

The design of the watch bracelet clasp briefly described above is considerably complex and cumbersome, particularly due to the dual hinge pivoting along two distinct axes of the lever and bolt on the cover. Hence there is a requirement for a watch bracelet clasp which is more compact and comprises a smaller number of parts for reliable operation.

BACKGROUND OF THE INVENTION

It is an object of the present invention to meet these expectations by providing a clasp for a watch bracelet or garment belt which comprises a limited number of parts yet ensures perfect closure of the clasp.

The present invention therefore concerns a clasp for a watch bracelet or for a garment belt comprising at least two unfolding arms articulated to each other; a first unfolding arm comprises a first end attached to a bracelet strand and a second end pivotally articulated to a first end of a second unfolding arm; a second end of the second unfolding arm is traversed by an arbour about which there is articulated a cover provided with first and second flaps and to which another bracelet strand is attached. The clasp also comprises a push button fastening system, and is characterized in that at least one push button controls a bolt pivotally mounted on the cover; the bolt comprises a first hook devised to cooperate with a second hook fitted to the first unfolding arm and to keep the second hook locked when the push button is not being manually activated, the first hook being kept engaged with the second hook by an elastic means.

Owing to these features, the present invention provides a clasp which operates both simply and reliably. Indeed, simply pressing on a push button is sufficient to open the clasp whereas, in the prior art, a lever had to be raised using a fingernail. The clasp according to the invention is thus much more intuitive to operate. Further, raising the lever with a fingernail may be problematic if the snap force of the lever is significant. Likewise, the absence of a dual hinge system on two distinct axes of the lever and bolt on the cover provides a much more compact clasp. Finally, since there are a limited number of elements involved in manufacturing the bolt, operation of the bolt is much more reliable.

According to a complementary feature of the invention, when the push buttons are activated, they force the bolt to pivot against the elastic force of the elastic means, so that the first hook is released from its engagement with the second hook.

According to another feature of the invention, when the push buttons are activated, they act on corresponding inclined planes of the bolt. The push buttons are therefore provided with inclined planes along which the inclined planes of the bolt slide.

According to yet another feature of the invention, the bolt is pivotally mounted on the cover by means of a hinge which extends parallel to the direction of actuation of the push buttons.

Thus, the push buttons act on the bolt in a parallel direction to the pivot axis of the bolt, which contributes to the compactness of the clasp of the invention.

SUMMARY OF THE INVENTION

Other features and advantages of the present invention will appear more clearly in the following detailed description of an embodiment of the clasp according to the invention. This example is given solely by way of non-limiting illustration with reference to the annexed drawing, in which.

SUMMARY OF THE INVENTION

The present invention proceeds from the general inventive idea which consists in providing a clasp for a watch bracelet or for a garment belt comprising a bolt, pivotally mounted on a cover, and provided with a first hook which engages with a second hook provided at the free end of an unfolding arm. To release the second hook from its engagement with the first hook, at least one, and preferably two push buttons are provided, which act on the bolt in a perpendicular direction to the longitudinal axis of symmetry of the clasp, forcing the bolt to pivot against the return force of elastic means. As a result of these features, the clasp of the invention is simple and intuitive to operate, since the user simply has to press on the push button(s) in order to open the clasp. Further, compared to the prior art, there is dispensed with a lever, which is always awkward to operate, particularly due to difficulties encountered in reproducibly calibrating the snap force. Therefore the clasp according to the invention has a reduced number of parts and operates more reliably. Finally, the push buttons act on the bolt in a direction which extends in the plane of the clasp, which produces a more compact clasp.

Figure 1:
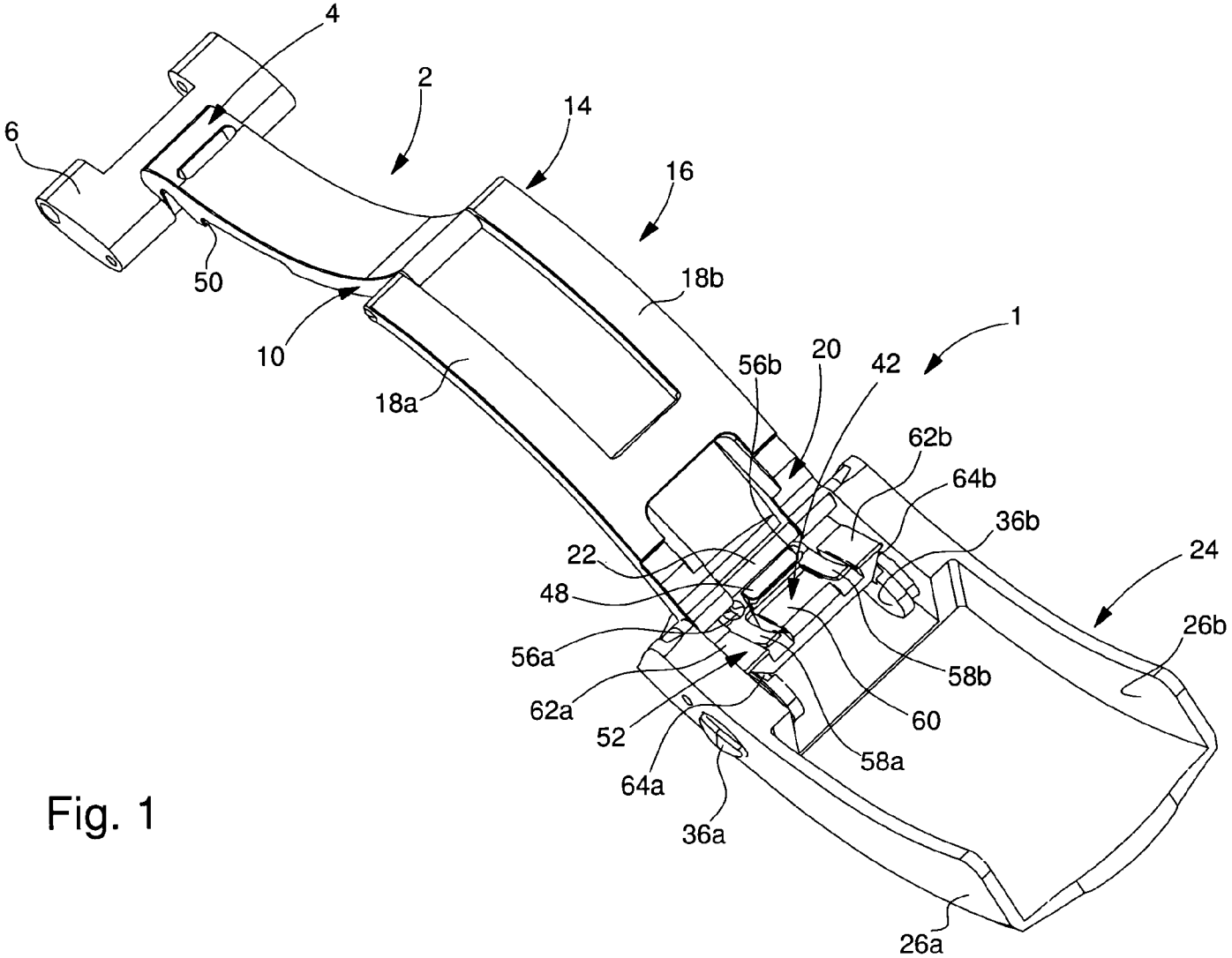
FIG. 1 is a perspective view of the clasp of the invention in an unfolded state.
Figure 2:
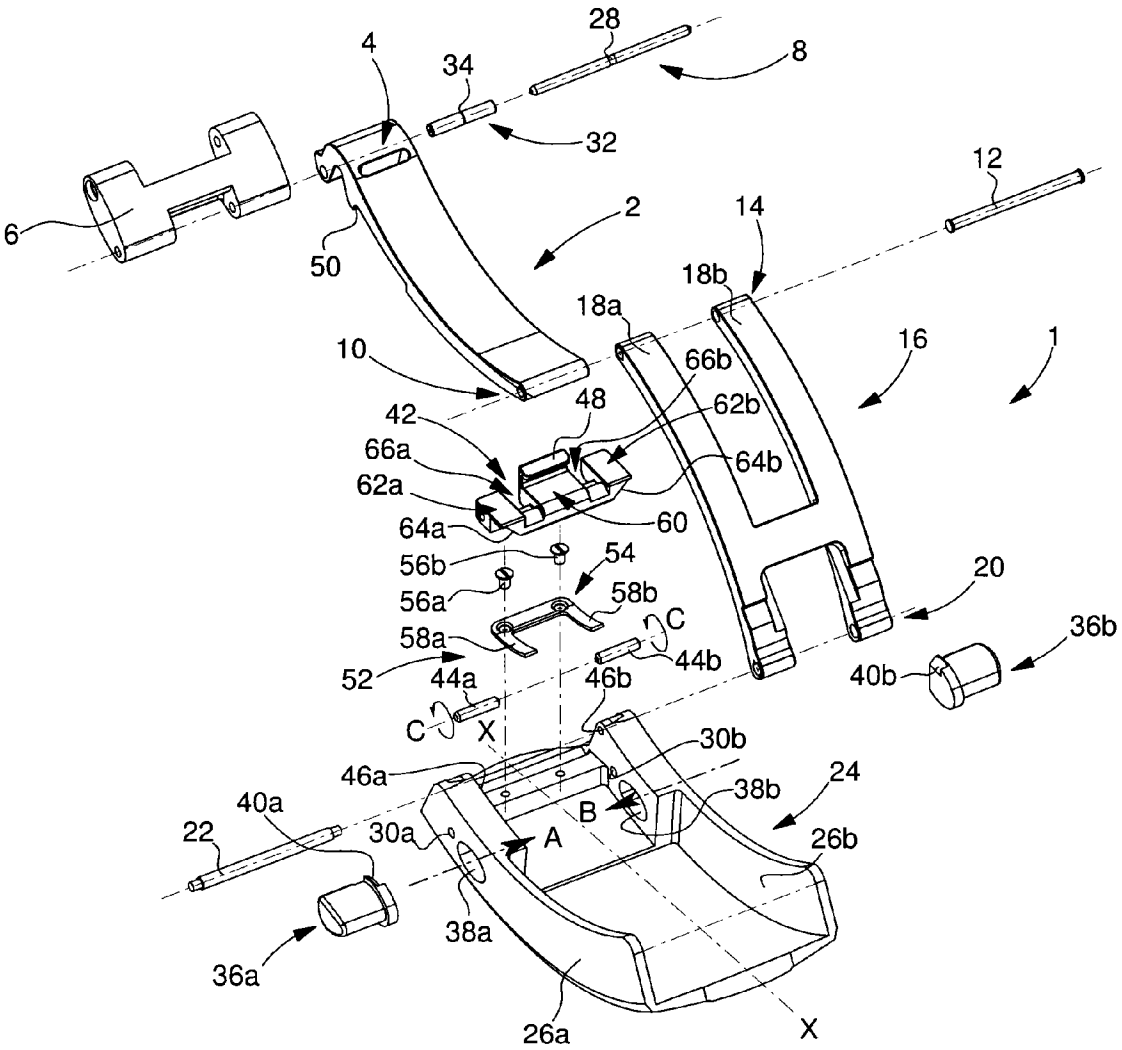
FIG. 2 is an exploded view of the clasp illustrated in FIG. 1.

FIGS. 1 and 2 are respectively perspective and exploded views of the clasp for a watch bracelet or for a garment belt of the invention together with its various constituent parts. Designated as a whole by the general reference numeral 1, the clasp includes a first unfolding arm 2, a first end 4 of which is attached to a bracelet strand 6, represented here by a first link, via an arbour 8. The second end 10 of first unfolding arm 2 is articulated by means of an arbour 12 on a first end 14 of a second unfolding arm 16. The second unfolding arm 16 is formed of two side members 18*a* and 18*b* between which first unfolding arm 2 is inserted when the clasp 1 is in the closed position. The second unfolding arm 16 is traversed at second end 20 by an arbour 22 about which there is articulated a cover 24, provided with first and second flaps 26*a* and 26*b*. Another bracelet strand, not shown in FIGS. 1 and 2, is attached to cover 24 and protrudes therefrom on the right of the Figures. In a conventional manner, arbour 8 is provided with a notch 28 and is held in place between holes 30*a* and 30*b* made in the first link of strand 6 by a pipe 32 provided with a constricted portion 34. FIGS. 1 and 2 also show that clasp 1 of the present invention includes a push button fastening system for locking and unlocking first and second unfolding arms 2 and 16.

The fastening system of the invention which will now be described includes at least one and preferably two identical push buttons 36*a* and 36*b*. These two push buttons 36*a* and 36*b*, disposed opposite each other, are housed in two through holes 38*a* and 38*b* made in flaps 26*a* and 26*b* of cover 24. The two push buttons 36*a* and 36*b* act in respective directions of actuation A and B which are represented by arrows in FIG. 2. It is to be noted that directions of actuation A and B extend in the plane of clasp 1 substantially perpendicularly to the longitudinal axis of symmetry X-X of clasp 1. It will also be noted on examining FIG. 2 that push buttons 36*a* and 36*b* each have an inclined plane 40*a* and 40*b* whose role will be explained below.

According to the invention, push buttons 36*a* and 36*b* control a bolt 42, pivotally mounted on cover 24 by means of a hinge C, which extends parallel to the direction of actuation of push buttons 36*a* and 36*b* and which is formed of two small pins 44*a* and 44*b*. These two pins 44*a* and 44*b* penetrate holes 46*a* and 46*b* made in flaps 26*a* and 26*b* of cover 24. Bolt 42 includes a first hook 48, devised to cooperate with a second hook 50 provided on the side of the first end 4 of first unfolding arm 2 and intended to lock clasp 1 when the clasp 1 is in the closed position. Finally FIG. 2 shows that clasp 1 is fitted with elastic means 52 arranged to keep first hook 48 engaged with second hook 50 when push buttons 36*a* and 36*b* are not being manually activated.

More specifically, elastic means 52 takes the form of a plate 54 fixed to cover 24 by means of two screws 56*a* and 56*b* as seen in FIG. 2. This plate 54 is cut into a U-shape and has two external arms 58*a* and 58*b* which are slightly pre-stressed to eliminate any play. The two external arms 58*a* and 58*b* press on bolt 42 to keep first hook 48 engaged with second hook 50 when clasp 1 is in the closed position.

Figure 3:
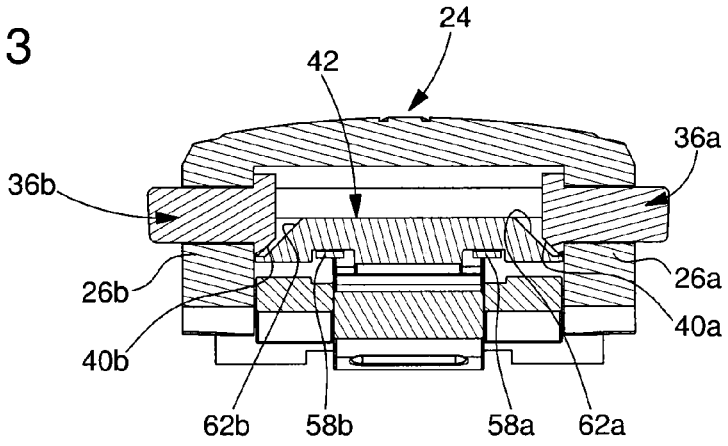
FIG. 3 is a transverse cross-section through the push buttons of the clasp of the invention shown in the closed position.
Figure 4:
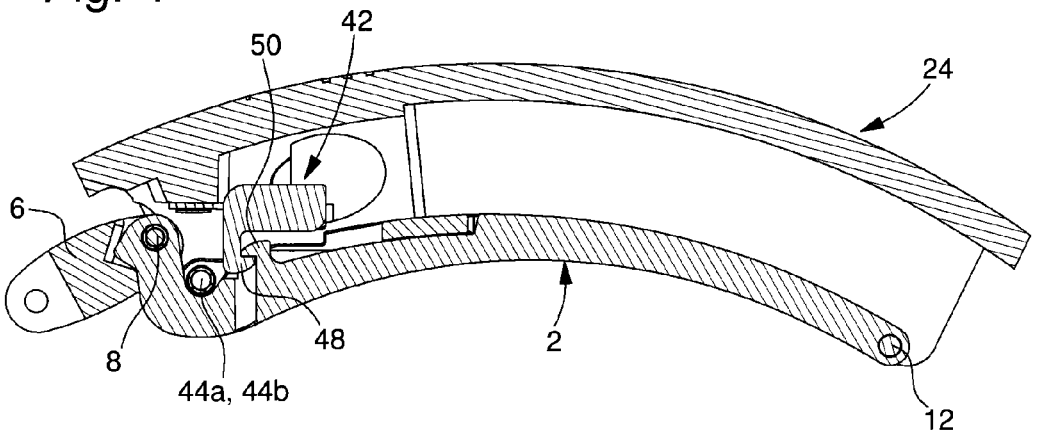
FIG. 4 is a longitudinal cross-section of the clasp of the invention in a closed position.

According to the invention, bolt 42 includes a central portion 60, on which first hook 48 is mounted, and which is flanked by two end portions 62*a* ad 62*b* each having an inclined plane 64*a* and 64*b* along which the inclined planes 40*a* and 40*b* of push buttons 36*a* and 36*b* will slide. The two end portions 62*a* and 62*b* are separated from central portion 60 of bolt 42 by two recesses 66*a* and 66*b* into which the external arms 58*a* and 58*b* of plate 54 project. When clasp 1 is in the closed position (see in particular FIGS. 3 and 4), the external arms 58*a* and 58*b* of plate 54 elastically force bolt 42 to pivot clockwise about direction of articulation C, so as to keep first hook 48 engaged with second hook 50. When the user wishes to open clasp 1, he simply has to press simultaneously on both push buttons 36*a* and 36*b* in the direction of arrows A and B. As a result of this pressure, the inclined planes 64*a* and 64*b* of bolt 42 slide along the inclined planes 40*a* and 40*b* of push buttons 36*a* and 36*b*, which causes bolt 42 to pivot anticlockwise about direction of articulation C as shown by an arrow in FIG. 2.

Figure 5:
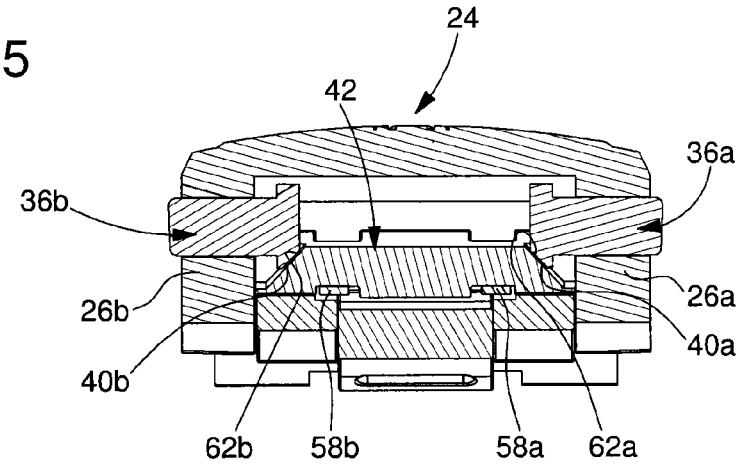
FIG. 5 is a transverse cross-section through the push buttons of the clasp of the invention shown in an open position.
Figure 6:
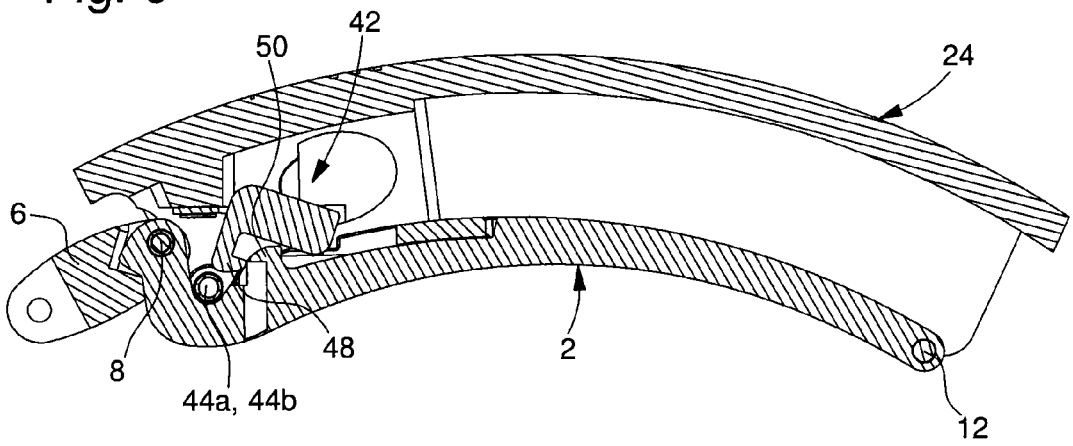
FIG. 6 is longitudinal cross-section of the clasp of the invention in an open position.

Next, first hook 48 carried by bolt 42 is released from its engagement with second hook 50 carried by first unfolding arm 2, which allows the two unfolding arms 2 and 16 to unfold (see FIGS. 5 and 6 in particular). It is then possible to open clasp 1. When the two unfolding arms 2 and 16 are folded onto each other again and the user releases pressure on push buttons 36*a* and 36*b*, the external arms 58*a* and 58*b* of plate 54 again elastically force bolt 42 to pivot clockwise about direction of articulation C, which causes first hook 48 to engage again with second hook 50. The clasp is closed again.

Figure 7:
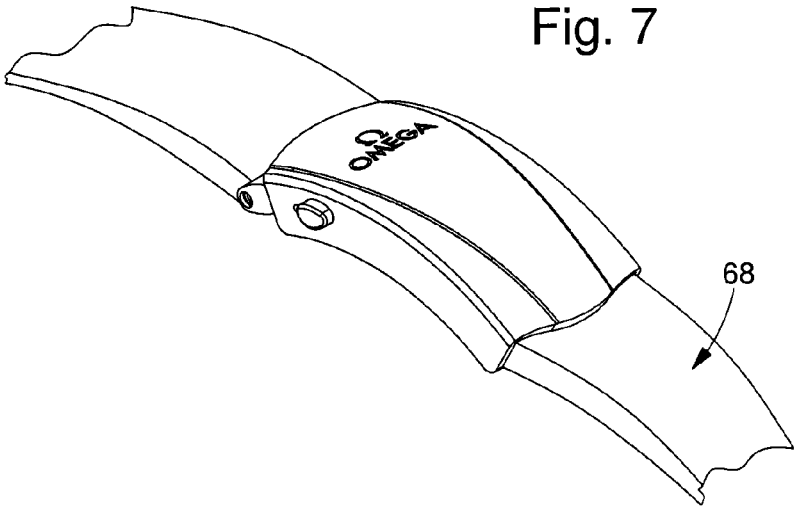
FIG. 7 is a view of the clasp used for a garment belt.
Figure 8:
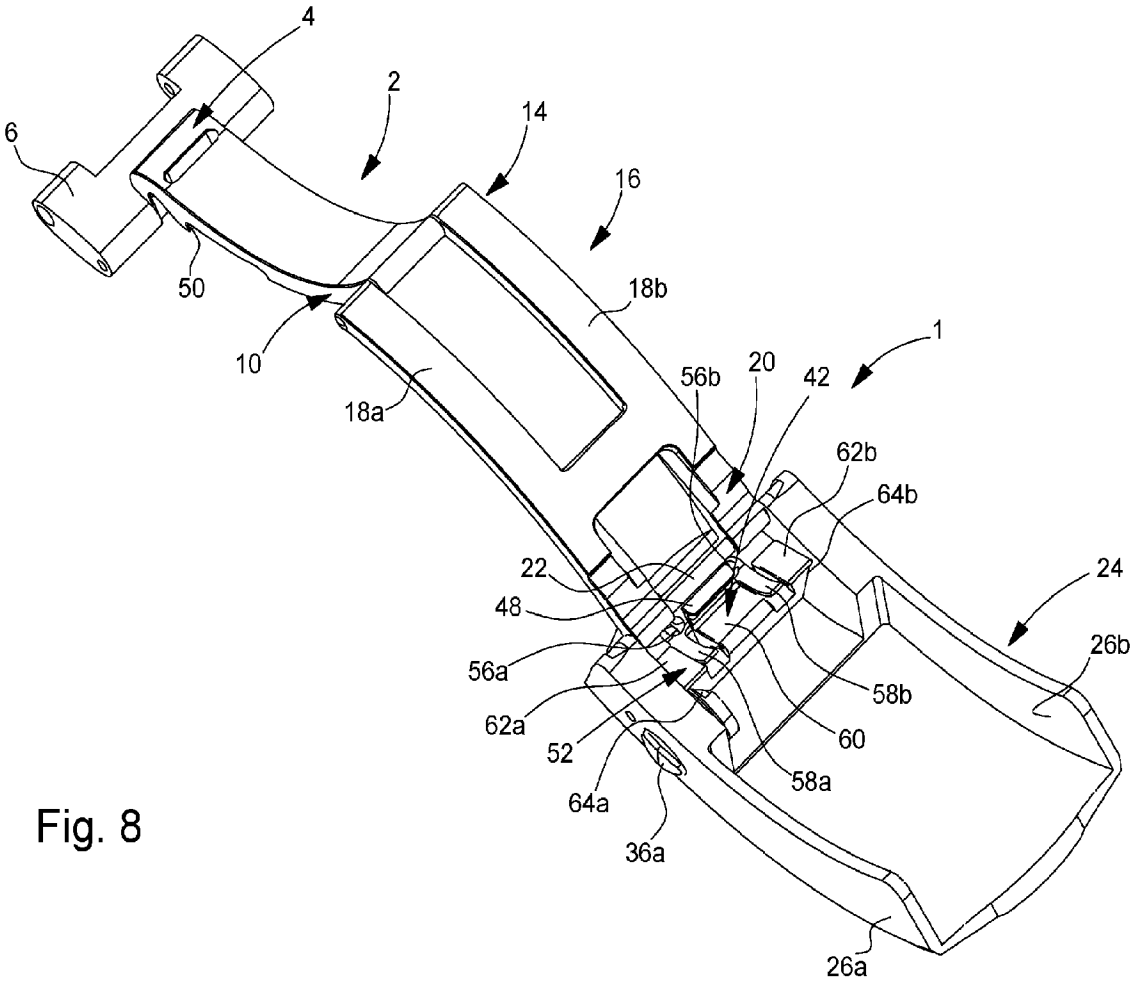
FIG. 8 is a perspective view of a second illustrative embodiment of a clasp in an unfolded state.
Figure 9:
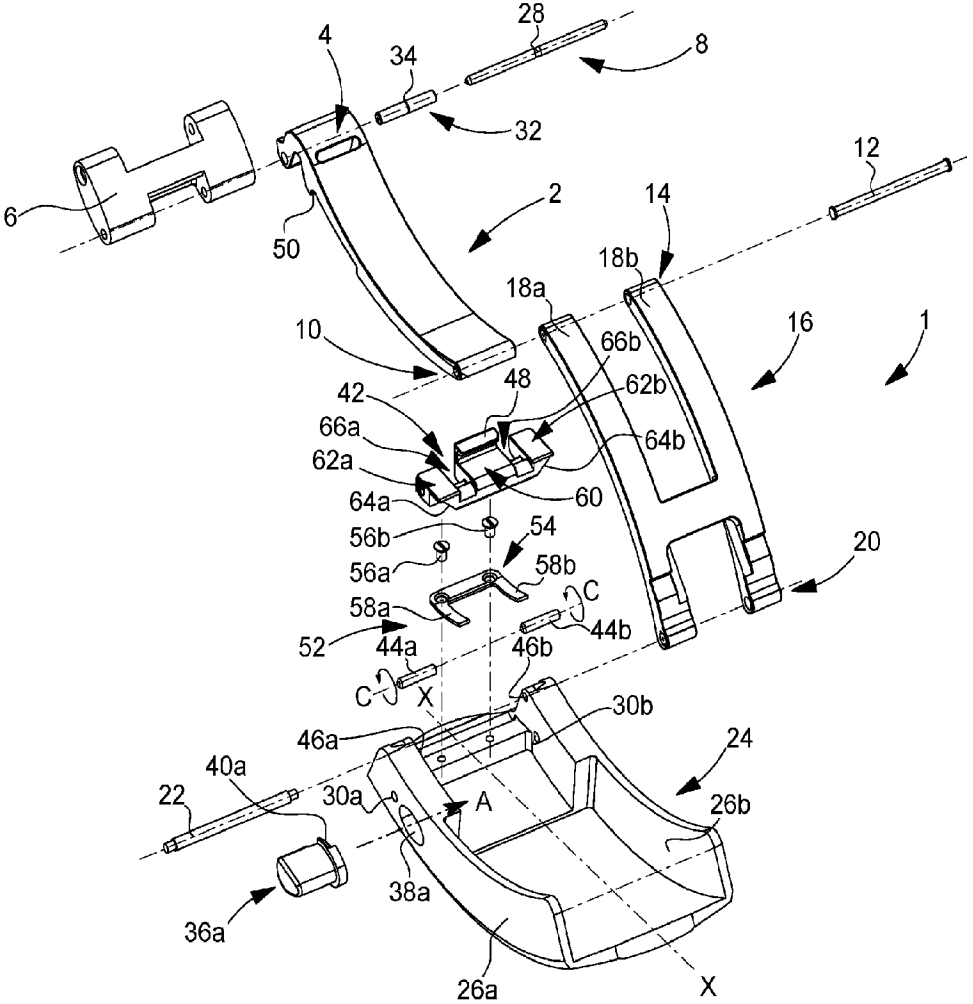
FIG. 9 is an exploded view of the clasp illustrated in FIG. 8.
Figure 10:
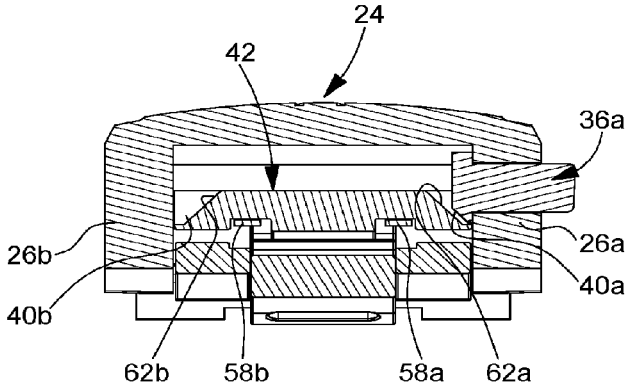
FIG. 10 is a transverse cross-section through a push button of the clasp of the second illustrative embodiment shown in the closed position.
Figure 11:
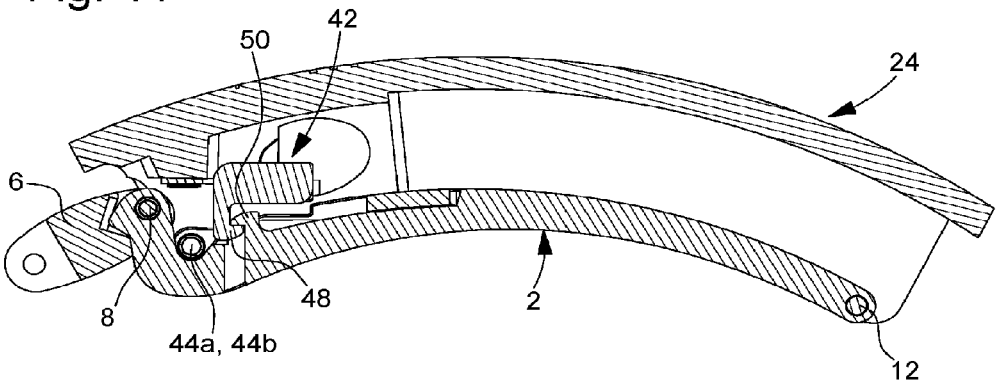
FIG. 11 is a longitudinal cross-section of the clasp of the second illustrative embodiment in a closed position.
Figure 12:
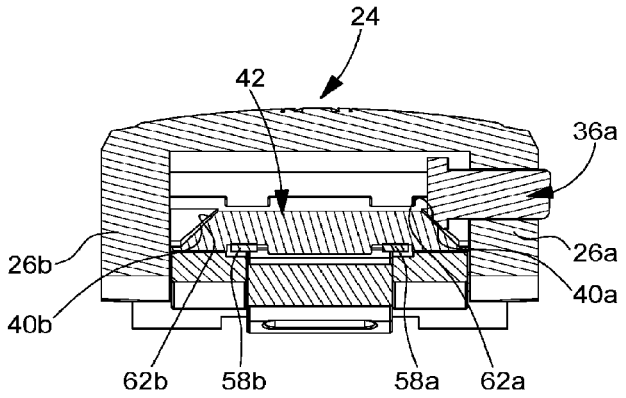
FIG. 12 is a transverse cross-section through the push button of the clasp of the second illustrative embodiment shown in an open position.
Figure 13:
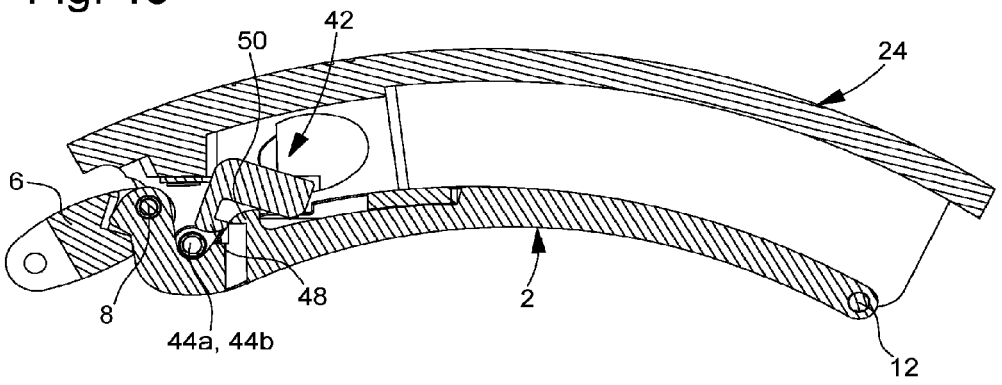
FIG. 13 is longitudinal cross-section of the clasp of the second illustrative embodiment in an open position.
Figure 14:
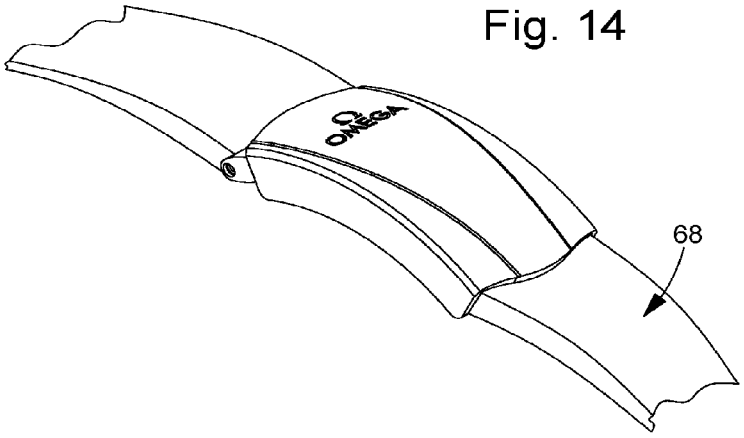
FIG. 14 is a view of the clasp of the second illustrative embodiment used for a garment belt.

It goes without saying that this invention is not limited to the embodiment that has just been described and that various simple alterations and variants can be envisaged by those skilled in the art without departing from the scope of the invention as defined by the annexed claims. In particular, clasp 1 according to the invention may also be used for a garment belt 68 as shown in FIG. 7. Further, clasp 1 of the invention was described with two push buttons 36*a* and 36 acting on two inclined planes 64*a* and 64*b* of bolt 42. It goes without saying that, in a simplified embodiment of the invention, there could be a single push button acting on a corresponding inclined plane of the bolt, as in the second illustrative embodiment shown in FIGS. 7 to 14, for example.

What is claimed is:

1. A clasp for a watch bracelet or for a garment belt comprising:

at least two unfolding arms articulated to each other, wherein a first unfolding arm comprises a first end attached to a bracelet strand and a second end pivotally articulated to a first end of a second unfolding arm, wherein a second end of the second unfolding arm is traversed by an arbour about which there is articulated a cover provided with first and second flaps and to which another bracelet strand is attached, wherein the clasp also comprises a push button fastening system, wherein at least one push button that acts in a direction perpendicular to a longitudinal axis of symmetry of the clasp controls a bolt pivotally mounted on the cover about an axis extending perpendicular to the longitudinal axis of symmetry of the clasp, wherein the bolt comprises a first hook devised to cooperate with a second hook fitted to the first unfolding arm and to keep said second hook locked when the push button is not being manually activated, wherein the first hook is kept engaged with the second hook by an elastic structure.

2. The clasp according to claim 1, wherein the elastic structure takes a form of a plate cut into a U-shape and including two external arms, which press on the bolt to keep the first hook engaged with the second hook in the closed position of the clasp.

3. The clasp according to claim 2, wherein, when the at least one push button is actuated, the push button forces the bolt to pivot against an elastic force of the elastic structure, so that the first hook is released from engagement with the second hook.

4. The clasp according to claim 3, wherein, when actuated, the at least one push button acts on corresponding inclined surfaces of the bolt.

5. The clasp according to claim 4, wherein, when the at least one push button is actuated, the bolt slides via the inclined surfaces thereof along corresponding inclined surfaces provided on the push button.

6. The clasp according to claim 1, wherein, when the at least one push button is actuated, the push button forces the bolt to pivot against an elastic force of the elastic structure, so that the first hook is released from engagement with the second hook.

7. The clasp according to claim 6, wherein, when actuated, the at least one push button acts on corresponding inclined surfaces of the bolt.

8. The clasp according to claim 7, wherein, when the at least one push button is actuated, the bolt slides via the inclined surfaces thereof along corresponding inclined surfaces provided on the push button.

9. The clasp according to claim 1, wherein the at least one push button acts on the bolt in a transverse direction to the longitudinal axis of symmetry of the clasp and which extends in a plane of the clasp.

10. The clasp according to claim 9, wherein the bolt is pivotally mounted on the cover by a hinge which extends parallel to the direction of actuation of the at least one push button.

11. The clasp according to claim 10, wherein the hinge is formed of two pins which penetrate holes made in the flaps of the cover.

12. The clasp according to claim 1, wherein the second hook is provided on a side of the first end of the first unfolding arm, opposite the second end of said first unfolding arm, which is pivotally articulated on the first end of the second unfolding arm.

* * * * *